US005766045A

United States Patent [19]

Sawaki et al.

[11] Patent Number: 5,766,045

[45] Date of Patent: Jun. 16, 1998

[54] CONDUCTOR CONNECTION TERMINAL UNIT

[75] Inventors: Yoshiaki Sawaki, Tokyo; Tadashi Ikezawa, Shiga, both of Japan

[73] Assignee: Furukawa Electric Co., Ltd., Tokyo, Japan

[21] Appl. No.: 733,823

[22] Filed: Oct. 18, 1996

[51] Int. Cl.[6] ..... H01R 13/11

[52] U.S. Cl. ..... 439/857

[58] Field of Search ..... 439/857, 856, 439/845, 249, 250, 251, 830, 831, 832, 833, 621, 622, 839, 849, 850

[56] References Cited

U.S. PATENT DOCUMENTS

| | | | |
|---|---|---|---|
| 1,589,066 | 6/1926 | Gibbons | 439/839 |
| 3,768,068 | 10/1973 | Palecek | 439/857 |
| 3,850,500 | 11/1974 | Cobaugh et al. | 439/857 |
| 4,041,358 | 8/1977 | Donahue et al. | 439/839 |
| 4,932,891 | 6/1990 | Spanke et al. | 439/856 |

FOREIGN PATENT DOCUMENTS

| | | | |
|---|---|---|---|
| 1140583 | 3/1957 | France | 439/833 |
| 2007131 | 1/1970 | France | 439/833 |
| 1015090 | 9/1957 | Germany | 439/833 |
| 5-15342 | 2/1993 | Japan . | |

*Primary Examiner*—Neil Abrams
*Assistant Examiner*—Tho D. Ta
*Attorney, Agent, or Firm*—Armstrong, Westerman, Hattori, McLeland & Naughton

[57] ABSTRACT

A female-type terminal unit provided with an insertion portion for insertion of a male-type terminal at one end and a conductor connection portion for connecting with a conductor at the other end. A male-type terminal insertion portion is formed by facing plate-shaped terminal pieces. At the base side of the plate-shaped terminal pieces is provided a stopper piece for stopping the spread of the two plate-shaped terminal pieces when a male-type terminal is press-fit there. The two facing plate-shaped terminal pieces will not plastically deform due to twisting by the male-type terminal. Further, the stopper piece prevents the plate-shaped terminal pieces from excessively spreading apart.

3 Claims, 6 Drawing Sheets

CONDUCTOR CONNECTION TERMINAL UNIT

BACKGROUND OF THE INVENTION

1. Field of the Invention

The present invention relates to a conductor connection terminal unit used for connecting two conductors, more particularly relates to an improvement of a female-type terminal unit which reduces the deformation caused by a load applied at the time of connection of the conductors.

2. Description of the Related Art

FIG. 1A to FIG. 1C are views of a female type terminal unit of the related art, wherein FIG. 1A is a side view, FIG. 1B is a front view, and FIG. 1C is a plan view. FIG. 2 is a perspective view of an example of use of a female-type terminal unit.

The female-type terminal unit illustrated in FIG. 1A to FIG. 1C is comprised of a male-type terminal insertion portion 1 which receives a male-type terminal at one end and a conductor connection portion 2 for connecting to another conductor at its other end. The male-type terminal insertion portion is formed as a female shape receiving a male-type terminal. Accordingly, the terminal unit is referred to as a female-type terminal unit.

The male-type terminal insertion portion 1 and the conductor connection portion 2 are formed by copper or another material with a good electrical conductivity (conductive material).

The female-type terminal unit connects the male-type terminal and a cord or other conductor. An example of its use will be explained with reference to FIG. 2.

As illustrated in FIG. 2, the female-type terminal unit is used with a conductor connection portion 2 inserted into a bus bar unit 110 of a conductor arranged in a fuse box 100 and with the male-type terminal (not shown) of the fuse connected to the male-type terminal insertion portion 1 so as to connect the bus bar 110 and the male-type terminal of the fuse. As another example of use of the female-type terminal unit, it is also possible to connect a cord etc. to the conductor connection portion 2 instead of the bus bar and connect various male-type terminals to the male-type terminal insertion portion 1.

The construction of the female-type terminal unit will next be explained. An elastic tongue piece 1*a* made of an elastomer and formed in the shape of a tongue is formed inside the male-type terminal insertion portion 1. A side wall portion 1*b* is formed bent into a box shape at the male-type terminal insertion portion 1. To prevent the box-shaped side wall 1*b* from opening up, a tip-open prevention piece 1*c* is formed to hold down the outside of the side wall 1*b*. The conductor connection portion 2 is formed with its two side walls bent into U-shapes.

In a female-type terminal unit of the above configuration, however, when connecting the male-type terminal (not shown) of the fuse in the fuse box 100 to the male-type terminal insertion portion 1, sometimes the male-type terminal of the fuse is inserted at an angle with respect to the normal insertion direction so the male-type terminal insertion portion 1 sometimes deforms (is pinched or twisted). If the male-type terminal insertion portion 1 deforms (is pinched or twisted) in this way, the elastic tongue piece 1*a* ends up plastically deforming and the trouble occurs of loss of some electrical contact between the elastic tongue piece 1*a* and the male-type terminal of the fuse. That is, if the above female-type terminal unit is used, poor contact of the male-type terminal insertion portion 1 and the male-type terminal of the fuse occurs and as a result poor electrical contact occurs between the bus bar connected to the conductor connection portion 2 and the male-type terminal of the fuse connected to the male-connected to the male-type terminal insertion portion 1.

To deal with the above disadvantage, Japanese Unexamined Utility Model Publication (Kokai) No. 5-15342 discloses a terminal unit provided with a deformation (twist) preventing mechanism for elastic contact pieces which prevents excessive bending of elastic contact pieces with U-shaped tongue pieces. According to the terminal unit disclosed in Japanese Unexamined Utility Model Publication (Kokai) No. 5-15342, the excessive opening of the elastic contact pieces can be prevented by the deformation (twist) prevention mechanism, so it is possible to prevent excessive bending of the elastic contact pieces. However, since the elastic contact pieces are formed with tongue pieces bent in U-shapes, if the U-shaped portions are deformed (pinched or twisted) by the male-type terminals, those portions undergo plastic deformation and the trouble arises of loss of electrical contact between the elastic contact pieces and male-type terminals.

The above explanation of the related art was made with reference to the case of a female-type terminal unit, but this was only an example. The same type of trouble is encountered in other conductor connection terminal units similar to the above connecting two conductors.

SUMMARY OF THE INVENTION

An object of the present invention is to provide a conductor connection terminal unit, for example, a female-type terminal unit, which prevents deformation in the conductor connection terminal unit.

Another object of the present invention is to provide a conductor connection terminal unit where the male-type terminal insertion portion will not excessively be spread open even if a male-type terminal is press-fit therein and therefore can stably maintain the electrical contact of a male-type terminal over a long period.

According to the present invention, there is provided a conductor connection terminal unit, comprising, at one end: a male-type terminal insertion portion having two parallel conductive plate portions facing each other across a predetermined distance for receiving a male-type terminal and a stopper piece for stopping the two parallel conductive plate portions from spreading apart more than a predetermined distance when a male-type terminal is inserted.

If as explained above the male-type terminal insertion portion is formed by facing plate-shaped terminal pieces, there is no plastic deformation of the facing plate-shaped terminal pieces themselves due to deformation (twisting) by the male-type terminal. Further, the stopper piece prevents the plate-shaped terminal pieces from excessively spreading apart. Therefore, deformation (twisting) by the male-type terminal does not cause the plate-shaped terminal pieces from excessively spreading apart.

Preferably, the male-type terminal insertion portion includes the two parallel conductive plate portions, two free portions at one ends of the parallel conductive portions, and two base portions of the other ends of the parallel conductive portions and the distance between the two base portions is larger than the distance between the two free portions.

Preferably, also, the male-type terminal insertion portion includes a first portion formed continuously by one of the two parallel conductive plate portions, the free portion of one end of the one parallel conductive portion, and the base portion of the other end of the one parallel conductive portion and a second portion formed continuously by the other of the two parallel conductive plate portions, the free portion of one end of the other parallel conductive portion, and the base portion of the other end of the other parallel conductive portion and the first portion and second portion face each other.

More preferably, the stopper piece is attached to the two facing base portions of the male-type terminal insertion portion and stops the two facing parallel conductive plate portions from spreading apart more than a predetermined distance.

As another aspect of the conductor connection terminal unit of the present invention, there is further provided a conductor connection portion having a portion connecting with a conductive member at the other end facing the male-type terminal insertion portion.

BRIEF DESCRIPTION OF THE DRAWINGS

These and other objects and features of the present invention will become clear from the following description of the preferred embodiments made with reference to the attached drawings, in which.

DESCRIPTION OF THE PREFERRED EMBODIMENTS

Preferred embodiments of the conductor connection terminal unit of the present invention will be explained in detail below with reference to the drawings.

First Embodiment

Figure 3A:
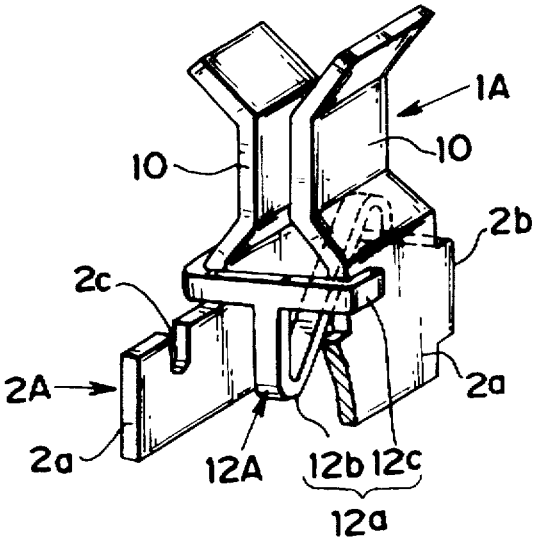
FIG. 3A to FIG. 3D are a perspective view, front view, plan view, and right side view of parts of a female-type terminal unit of a first embodiment of the conductor connection terminal unit of the present invention.
Figure 3C:
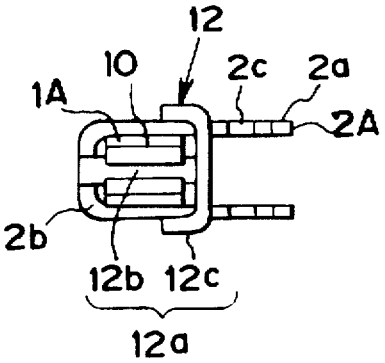
Figure 3B:
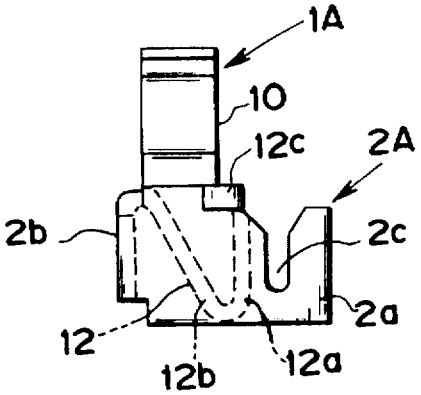
Figure 3D:
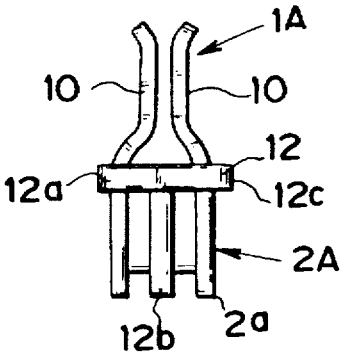

FIG. 3A to FIG. 3D are views of a female-type terminal unit of a first embodiment of the conductor connection terminal unit of the present invention, in which FIG. 3A is a perspective view of parts of the female-type terminal unit, FIG. 3B is a front view, FIG. 3C is a plan view, and FIG. 3D is a right side view.

The female-type terminal unit of the first embodiment of the present invention is provided at one end with a male-type terminal insertion portion 1A and at the other end with a conductor connection portion 2A for connecting with the other conductor to be connected and, further, is provided with a stopper piece 12A. In this embodiment, the male-type terminal insertion portion 1A, the conductor connection portion 2A, and the stopper piece 12A are formed integrally by a conductive material. The method of production will be explained later.

The construction of the female-type terminal unit of the first embodiment will be explained next.

Construction of Male-Type Terminal Insertion Portion 1A

Figure 1A:
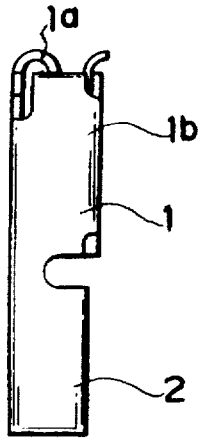
FIG. 1A to FIG. 1C are a side view, front view, and plan view of a conventional female-type terminal unit.
Figure 1B:
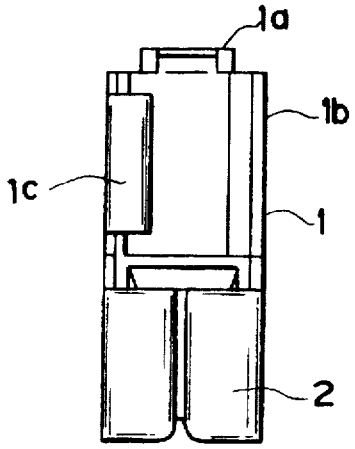
Figure 1C:
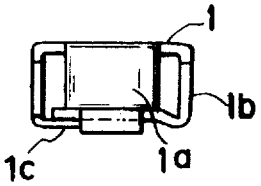
Figure 2:
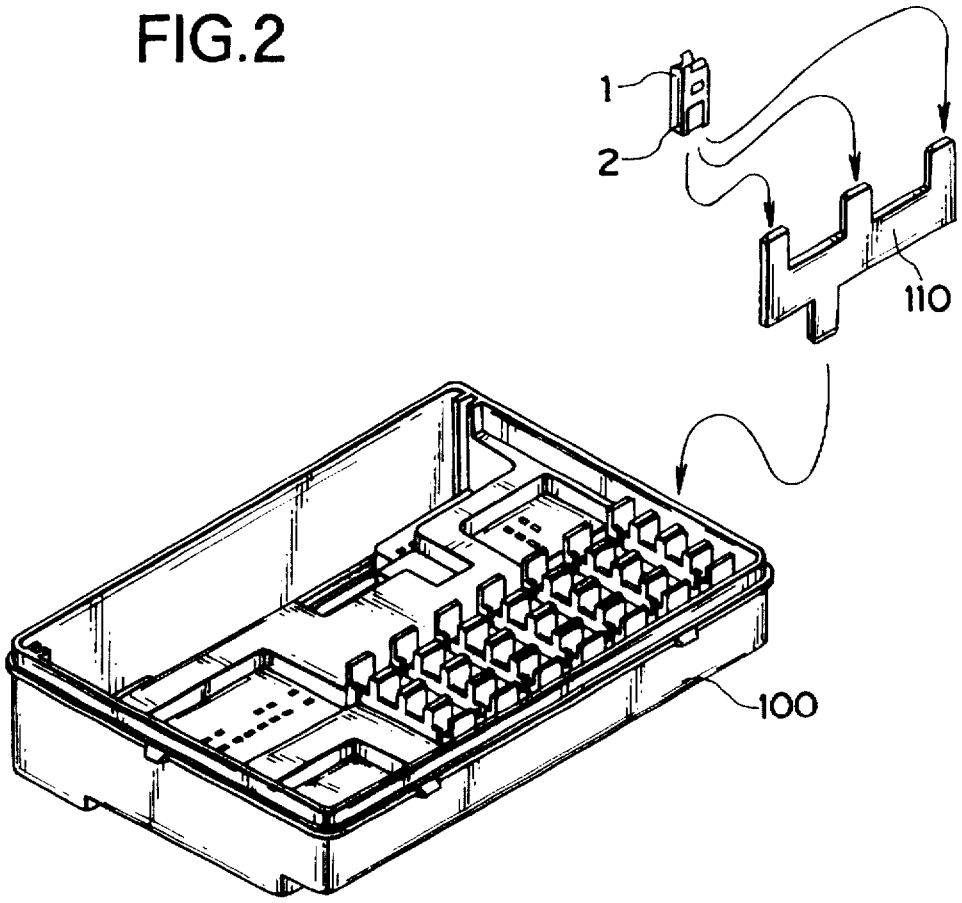
FIG. 2 is a perspective view of the state of use of the conventional female-type terminal unit.

The male-type terminal insertion portion 1A of the female-type terminal unit of the first embodiment is formed by two facing plate-shaped terminal pieces 10, 10. In the space between the two plate-shaped terminal pieces 10, 10, as shown in FIG. 2, a male-type terminal (not shown) such as the male-type terminal of a fuse is press-fit. The flat center portions of the two plate-shaped terminal pieces 10, 10 face other across a distance somewhat smaller than the thickness of the male-type terminal to be press-fit. The top ends of the terminal pieces 10, 10 open outward to facilitate insertion of the male-type terminal.

At the base portion side opposite to the top ends of the two plate-shaped terminal pieces 10, 10 is provided a stopper piece 12 for stopping the two plate-shaped terminal pieces 10, 10 from spreading apart by more than a predetermined distance when pushed apart by the male-type terminal being press-fit between their flat center portions. As a result, stable contact can be maintained with the male-type terminal press-fit between the flat center portions of the two plate-shaped terminal pieces 10, 10. The stopper piece 12 will be explained later.

Construction of Conductor Connection Portion 2A

The conductor connection portion 2A formed with cord press-fit portions **2*c* where the cord to be connected with is press-fit is formed in a substantially U-shape by two facing side plates 2*a*, 2*a*. That is, the conductor connection portion 2A has the facing side plates 2*a*, 2*a* connected at their back portions by a back connector 2*b* and has the front portions of the side plates 2*a*, 2*a* free. At the free top sides of the side plates 2*a*, 2*a* are formed the cord press-fit portions 2*c*** in which the cord to be connected is press-fit.

Construction of Stopper Piece 12A

The stopper piece 12A is formed from a substantially T-shaped stopper member **12*a* comprised of a perpendicular portion (arm portion) 12*c* and straight portion 12*b*. The stopper piece 12A is formed by bending a substantially T-shaped stopper member 12*a* projecting from the top of the back connector 2*b* of the conductor connection portion 2A. That is, the straight portion 12*b* of the stopper member 12*a* is bent double to an S-shape as illustrated by the broken line in FIG. 3A and FIG. 3B and the two ends of the perpendicular portion 12*c* are bent inward 90° at portions to sandwich the base portions of the two plate-shaped terminal pieces 10, 10** as illustrated in FIG. 3A and FIG. 3C.

Method of Production of Female-Type Terminal Unit

An example of the method of production of the female-type terminal unit of the first embodiment will be explained next.

The male-type terminal insertion portion 1A, the conductor connection portion 2A, and the stopper piece 12A of the above configuration are formed integrally.

First, for example, a flat metal sheet of copper or other conductive metal is punched to form the flat shape of the male-type terminal insertion portion 1A, conductor connection portion 2A, and stopper piece 12A.

Next, the punched piece is bent to form the three-dimensional construction of the male-type terminal insertion portion 1A and the three-dimensional construction of the conductor connection portion 2A explained above.

The straight portion **12*b* of the stopper piece 12A is bent to an S-shape between the facing side plates 2*a*, 2*a* of the conductor connection portion 2A, and the two ends of the perpendicular portion 12*c* are bent to sandwich the base portions of the two plate-shaped terminal pieces 10, 10**.

This enables fabrication of the female-type terminal unit illustrated in FIG. 3A. The female-type terminal unit of this embodiment can be easily fabricated in this way.

Example of Use of Female-Type Terminal Unit

An example of the method of use of the female-type terminal unit of the first embodiment will be explained next. A male-type terminal of a fuse, relay, etc. (not shown) is inserted between the flat center portions of the two plate-shaped terminal pieces 10, 10 from the open top end of the male-type terminal insertion portion 1A and a cord (not shown) is press-fit and connected at the cord press-fit portions **2*c* of the conductor connection portion 2**. Due to this, the male-type terminal of the fuse, relay, etc. and the cord can be electrically connected using the female-type terminal unit of the first embodiment.

Effect of First Embodiment

If the female-type terminal unit of the first embodiment is used, when inserting the male-type terminal of the fuse, relay, etc. between the flat center portions of the two plate-shaped terminal pieces 10, 10 of the male-type terminal insertion portion 1A, even if the male-type terminal insertion portion 1A is deformed (even if it is pinched or twisted) by the male-type terminal, the flat center portions of the two plate-shaped terminal pieces 10, 10 of the male-type terminal insertion portion 1A will not plastically deform since they are flat plates. Further, the stopper piece 12A prevents the two plate-shaped terminal pieces 10, 10 from excessively spreading apart, so even if the male-type terminal is twisted, the two plate-shaped terminal pieces 10, 10 will not excessively spread apart. In this way, if the female-type terminal unit of this embodiment is used, it is possible to maintain a good electrical contact of the male-type terminal and conductor over a long period.

The female-type terminal unit of the present invention is not limited to the above embodiment and can be modified in various ways.

Second Embodiment

Figure 4:
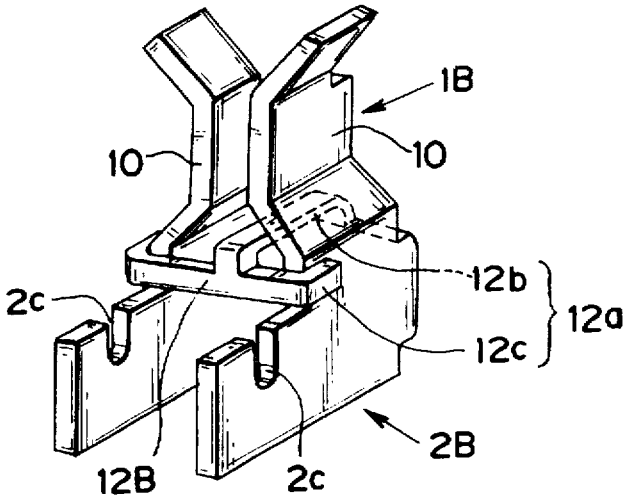
FIG. 4 is a perspective view of a female-type terminal unit of a second embodiment of the conductor connection terminal unit of the present invention.

FIG. 4 shows a second embodiment of the female-type terminal unit of the present invention. FIG. 4 corresponds to FIG. 3A.

The female-type terminal unit of the second embodiment, like the female-type terminal unit of the first embodiment, is comprised of a male-type terminal insertion portion 1B, conductor connection portion 2B, and stopper piece 12B integrally formed from a single conductive metal sheet. The female-type terminal unit of the second embodiment differs from the female-type terminal unit of the first embodiment in the following points:

1. The free tips of the two plate-shaped terminal pieces 10, 10 of the male-type terminal insertion portion 1B of the female-type terminal unit of the second embodiment are partially cut away.

2. The construction of the stopper piece 12B is different.

The stopper piece 12B of the second embodiment does not have the straight portion **12*b* of the substantially T-shaped stopper member 12*a* bent to an S-shape between the base portions of the two plate-shaped terminal pieces 10, 10 as in the first embodiment. Rather, the straight portion 12*b* of the substantially T-shaped stopper member 12*a* is bent to a handle shape between the two plate-shaped terminal pieces 10, 10. The stopper piece 12B stops the base portions of the two plate-shaped terminal pieces 10, 10** from spreading apart too much in the same way as the first embodiment.

The second embodiment is more advantageous than the first embodiment in that the bending of the straight portion **12*b* of the T-shaped stopper member 12*a* of the stopper piece 12B** is easier.

Third Embodiment

Figure 5:
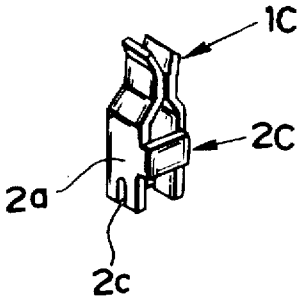
FIG. 5 is a perspective view of part of the female-type terminal unit of a third embodiment of the conductor connection terminal unit of the present invention.

FIG. 5 illustrates the male-type terminal insertion portion 1C and the conductor connection portion 2C of the female-type terminal unit of a third embodiment of the present invention.

The female-type terminal unit of the third embodiment is provided with a male-type terminal insertion portion 1C and conductor connection portion 2C. A stopper piece 12C is provided in the same way as in the first embodiment or second embodiment, but is not illustrated here.

In the female-type terminal unit of the third embodiment, the cord press-fit portions **2*c* in the conductor connection portion 2C are provided facing downward from the side plates 2*a*, 2*a***. The rest of the configuration is similar to that of the first embodiment or second embodiment.

In the female-type terminal unit of the third embodiment, the terminal is inserted into the male-type terminal insertion portion 1C by pushing it in from above. The cord is press-fit into the cord press-fit portions **2*c* of the conductor connection portion 2C**. When the male-type terminal and cord are arranged in this way, use of the female-type terminal unit of the third embodiment is preferred.

Fourth Embodiment

Figure 6:
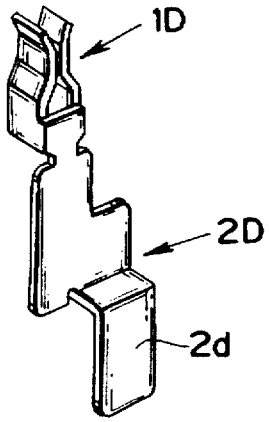
FIG. 6 is a perspective view of part of the female-type terminal unit of a fourth embodiment of the conductor connection terminal unit of the present invention.

FIG. 6 illustrates the male-type terminal insertion portion 1D and the male-type conductor connection portion 2D of the female-type terminal unit of a fourth embodiment of the present invention.

The female-type terminal unit of the fourth embodiment is provided with a male-type terminal insertion portion 1D and male-type conductor connection portion 2D. A stopper piece 12D is provided in the same way as in the first embodiment or second embodiment, but is not illustrated here.

In the female-type terminal unit of the fourth embodiment, a male-type terminal portion **2*d* is provided at the bottom end of the male-type conductor connection portion 2D. A male-type terminal is connected to this male-type terminal portion 2*d*. The male-type terminal insertion portion 1D** is similar to those of the above embodiments.

The female-type terminal unit of the fourth embodiment is used for connecting the male-type terminal to the male-type terminal insertion portion 1D from the top side, not shown, and connecting the male-type terminal to the conductor connection portion 2D from the bottom side.

Fifth Embodiment

Figure 7:
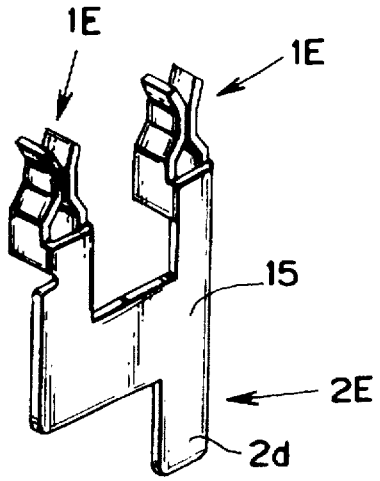
FIG. 7 is a perspective view of part of the female-type terminal unit of a fifth embodiment of the conductor connection terminal unit of the present invention.

FIG. 7 illustrates part of the female-type terminal unit of a fifth embodiment of the present invention.

The female-type terminal unit of the fifth embodiment is provided with a plurality of male-type terminal insertion portions 1E, in the illustration, two, connected by a connecting plate 15. The connecting plate 15 is provided with a conductor connection portion 2E, having the male-type terminal portion 2*d* illustrated in the fourth embodiment, at the bottom of the male-type terminal insertion portion 1E at the right in the illustration. Illustration of the stopper piece 12A (12B) explained in the first embodiment (second embodiment) is omitted here.

The female-type terminal unit of the fifth embodiment is used with two male-type terminals press-fit for connection in the two male-type terminal insertion portions 1E and 1E for connection to the male-type terminal portion 2*d* forming a single conductor.

The illustration shows two male-type terminal insertion portions 1E and one conductor connection portion 2D, but the numbers may be changed in accordance with the specific application. For example, a single male-type terminal insertion portion 1E and two conductor connection portions 2D may be provided.

Modification of Fifth Embodiment

Figure 8:
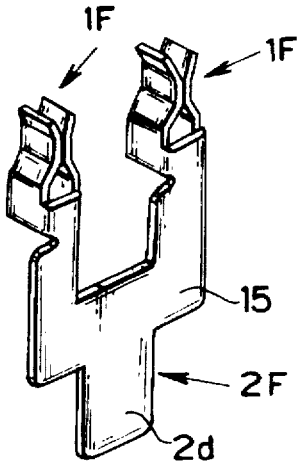
FIG. 8 is a perspective view of part of the female-type terminal unit of a modification of the fifth embodiment of the conductor connection terminal unit of the present invention.

FIG. 8 illustrates part of the female-type terminal unit of a modification of the fifth embodiment of the present invention explained with reference to FIG. 7.

The female-type terminal unit of the modification of the fifth embodiment has two male-type terminal insertion portions 1F and 1F connected by a connecting plate 15. The connecting plate 15 is provided with a conductor connection portion 2F having the male-type terminal portion 2*d* illustrated in the fourth embodiment. The two male-type terminal insertion portions 1F, 1F are the same as the two male-type terminal insertion portions 1E, 1E of the fifth embodiment.

In this modification, the male-type terminal portion 2*d* is provided at the bottom of the two male-type terminal insertion portions 1F and 1F. In this modification as well, illustration of the stopper piece 12A (12B) explained in the first embodiment (second embodiment) is omitted.

The female-type terminal unit of the fifth embodiment is used with two male-type terminals press-fit for connection in the two male-type terminal insertion portions 1F and 1F for connection to the male-type terminal portion 2*d* forming a single conductor.

Sixth Embodiment

Figure 9A:
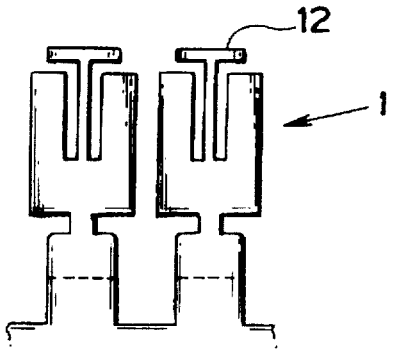
FIG. 9A to FIG. 9C are views illustrating the method of production of the female-type terminal unit of the conductor connection terminal unit of the present invention explained above.
Figure 9B:
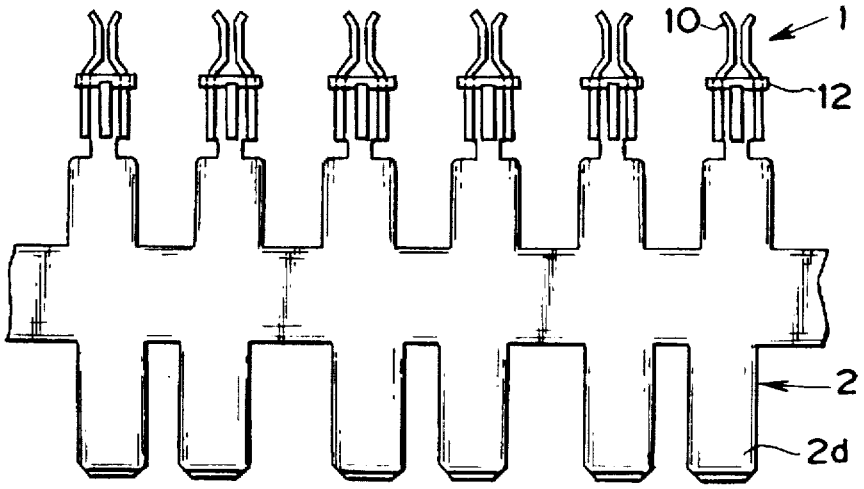
Figure 9C:
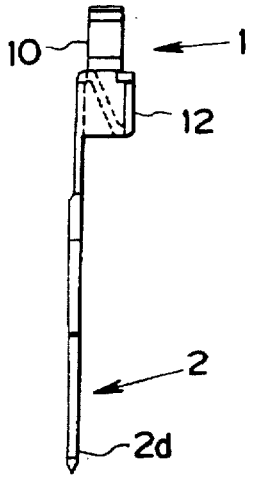

FIG. 9A to FIG. 9C show an example of the method of production in the case where the conductor connection portion is a male-type terminal 2*d* such as with the female-type terminal unit of the fourth embodiment explained with reference to FIG. 6, the female-type terminal unit of the fifth embodiment explained with reference to FIG. 7, and the female-type terminal unit of the modification of the fifth embodiment explained with reference to FIG. 8.

The method of production of the female-type terminal unit will be explained below:

a. A conductive metal sheet is punched as illustrated in FIG. 9*a*.

b. As illustrated in FIG. 9B, the male-type terminal insertion portion 1 (1C, 1D, 1E, 1F) is formed by bending.

c. The portion corresponding to the stopper piece 12, not shown, is bent, and the tips of the perpendicular portion of the stopper piece 12 are bent 90° to sandwich the base portions of the portions corresponding to the two plate-shaped terminal pieces 10, 10 of the male-type terminal insertion portion 1 so that the two plate-shaped terminal pieces 10, 10 will not spread apart more than a predetermined distance.

d. Suitably thereafter, the male-type terminal insertion portions 1 connected in the longitudinal direction are cut into single or multiple portion units to produce the above female-type terminal units.

In this way, the female-type terminal unit is comprised of an integrally formed male-type terminal insertion portion 1, conductor connection portion 2, and stopper piece 2 and therefore can be easily made. Accordingly, it can be produced inexpensively and is suited for mass production. Further, the female-type terminal unit can be produced in large quantities at the same high quality since the processing involved is simple.

Note that the method of production of the female-type terminal unit is not limited to integral formation as in the above example and also includes individual fabrication of the pieces corresponding to the male-type terminal insertion portion 1, conductor connection portion 2, and stopper piece 12 and assembly of these as explained above to form the female-type terminal unit.

As preferable embodiments of the conductor connection terminal unit of the present invention, illustration was made of a female-type terminal unit having a male-type terminal insertion portion at one end and a male-type terminal or cord or bus bar or other conductor connected at the other end, but the present invention is not limited to these embodiments and may be applied to various other conductor connection terminal units as well.

For example, as another embodiment of the conductor connection terminal unit of the present invention, it is possible to form a conductor connection terminal unit provided with just a male-type terminal insertion portion having two plate-shaped terminal pieces 10, 10 at one end and provided with a stopper piece 12 for preventing the male-type terminal insertion portion from spreading apart more than a predetermined distance when the male-type terminal is press-fit into it. Further, it is possible to fabricate another conductor connection terminal unit provided with the male-type terminal insertion portion at one end and connecting nothing or connecting something other than the above conductor at the other end.

As explained above, since the conductor connection terminal unit according to the present invention is provided with a male-type terminal insertion portion having, at least at one end, two plate-shaped terminal pieces and a stopper piece is provided at the base portion of the male-type terminal insertion portion so that the two plate-shaped terminal pieces will not spread apart more than a predetermined distance even if a male-type terminal is press-fit into the male-type terminal insertion portion, the two plate-shaped terminal pieces will not plastically deform even if the male-type terminal is press-fit and it is possible to prevent the two plate-shaped terminal pieces from excessively spreading apart. As a result, when the conductor connection terminal unit of the present invention is used, it is possible to stably connect a male-type terminal over a long period.

We claim:

1. A conductor connection terminal unit comprising:

a first end and a second end;

a male-type terminal insertion portion at said first end of said conductor connection terminal unit, wherein said male-type terminal insertion portion has two parallel conductive plate portions facing each other across a predetermined distance for receiving a male-type terminal therebetween, two free portions with each free portion connected to a first end of each of said parallel conductive plate portions at an obtuse angle so as to project outwardly from each of said parallel conductive plate portions, and two base portions connected to a second end of each of said parallel conductive plate portions at an obtuse angle so as to project outwardly from each of said parallel conductive plate portions, wherein said two free portions and said two base portions are connected to said two parallel conductive plate portions so that a distance between said two base portions is larger that a distance between said two free portions;

a stopper piece for stopping said two parallel conductive plate portions from spreading apart more than said predetermined distance when a male-type terminal is inserted into said conductor connection terminal unit between said two parallel conductive plate portions, wherein said stopper piece is attached to said two facing base portions of said male-type terminal insertion portion to stop said two facing parallel conductive plate portions from spreading apart more than said predetermined distance;

a conductor connection portion having a portion for connecting with a conductive member at the second end of said conductor terminal unit facing said male-type terminal insertion portion; and wherein said conductor connection portion, said male-type terminal insertion portion, and said stopper piece are formed by punching and bending a single conductive plate member.

2. A conductor connection terminal unit as set forth in claim 1, wherein said male-type terminal insertion portion comprises a first portion formed continuously by one of the two parallel conductive plate portions, the free portion of one end of said one parallel conductive portion, and the base portion of the other end of said one parallel conductive portion a second portion formed continuously by the other of the two parallel conductive plate portions, the free portion of one end of said other parallel conductive portion, and the base portion of the other end of said other parallel conductive portion and said first portion and second portion face each other.

3. A conductor connection terminal unit as set forth in claim 1, wherein a plurality of said male-type terminal insertion portions are provided through a connection member and at least one conductor connection portion is connected at the other end of the connection member.

* * * * *

UNITED STATES PATENT AND TRADEMARK OFFICE

CERTIFICATE OF CORRECTION

PATENT NO.: 5,766,045
DATED : June 16, 1998
INVENTOR(S): SAWAKI et al.

It is certified that errors appear in the above-identified patent and that said Letters Patent is hereby corrected as shown below:

On the title page of the patent, item "[73] Assignee: Furukawa Electric Co., Ltd., Tokyo, Japan" should be, -- [73] Assignee: The Furukawa Electric Co., Ltd., Tokyo, Japan --.

Signed and Sealed this

Twenty-seventh Day of June, 2000

*Attest:*

*Attesting Officer*

Q. TODD DICKINSON

*Director of Patents and Trademarks*